United States Patent [19]

Sirai et al.

[11] Patent Number: 5,073,128

[45] Date of Patent: Dec. 17, 1991

[54] MINIATURE ELECTRICAL CONTACT TERMINAL

[75] Inventors: Akira Sirai; Mitsuyosi Yamamoto; Haruo Kurosawa, all of Tokyo, Japan

[73] Assignee: Hirose Electric Co., Ltd., Tokyo, Japan

[21] Appl. No.: 715,386

[22] Filed: Jun. 14, 1991

[30] Foreign Application Priority Data

Aug. 30, 1990 [JP] Japan ..... 2-90022[U]

[51] Int. Cl.[5] ..... H01R 13/00

[52] U.S. Cl. ..... 439/585; 439/877

[58] Field of Search ..... 439/578-585, 439/877-881

[56] References Cited

U.S. PATENT DOCUMENTS 4,010,538 3/1977 O'Keefe et al. ..... 439/585

5,041,021 8/1991 Sato ..... 439/585

*Primary Examiner*—Joseph H. McGlynn

*Attorney, Agent, or Firm*—Kanesaka & Takeuchi

[57] ABSTRACT

A miniature electrical contact terminal includes a shield jacket (3) including a contact support section (6), a flat section (10) with a tool opening (11), a shield braid crimping section (7), and an outer sheath crimping section (8); an insulator block (4) fitted in the contact support section; and a signal line contact (5) fitted in the insulator block such that a pair of signal line crimping tabs (15*a*) placed above the tool opening.

3 Claims, 5 Drawing Sheets

MINIATURE ELECTRICAL CONTACT TERMINAL

BACKGROUND OF THE INVENTION

1. Field of the Invention

The present invention relates to miniature electrical connectors for shielded cables for use in electronic control units or the like and, more particularly, to miniature electrical contact terminals for such electrical connectors.

2. Description of the Prior Art

FIG. 8 shows a conventional electrical connector of this type, wherein a length of outer sheath g of a shielded cable a is removed to separate a shield braid b and a signal line c. The shield braid b is connected to the contact terminal e of a connector proper d while the signal line c is connected by insulation displacement, for example, to the contact terminal f of the connector proper d.

In the conventional electrical connector, however, it is necessary to connect separately the shield braid b and the signal line c to the respective contact terminals e and f, making the automation of the wiring operation difficult. In addition, there is no shield braid around the signal line c, providing little or no shield effect.

SUMMARY OF THE INVENTION

Accordingly, it is an object of the invention to provide a miniature electrical contact terminal.

It is another object of the invention to provide a miniature electrical contact terminal having a width smaller than that of a crimping die for crimping the signal line crimping tabs to the signal line of a shielded cable.

According to the invention there is provided a miniature electrical contact terminal which includes a shield jacket including a contact support section, a flat section with a tool opening, a shield braid crimping section, and an outer sheath crimping section; an insulator block fitted in the contact support section; and a signal line contact fitted in the insulator block such that a pair of signal line crimping tabs placed above the tool opening.

With the above miniature electrical contact terminal, the signal line crimping anvil is inserted through the tool opening to crimp the crimping tabs to the signal line while the shield braid and outer sheath crimping tabs are crimped to the shield braid and the outer sheath, respectively. Then, opposite sides of the flat section are bent upwardly to form a miniature electrical contact terminal. Thus, it is possible to make not only the tool opening as small as the crimping anvil but also the width of the shield jacket less than that of the crimper die, making the miniaturization of the electrical contact terminal possible.

The above and other objects, features, and advantages of the invention will be more apparent from the following description when taken in conjunction with the accompanying drawings.

DESCRIPTION OF THE PREFERRED EMBODIMENT

Figure 1:
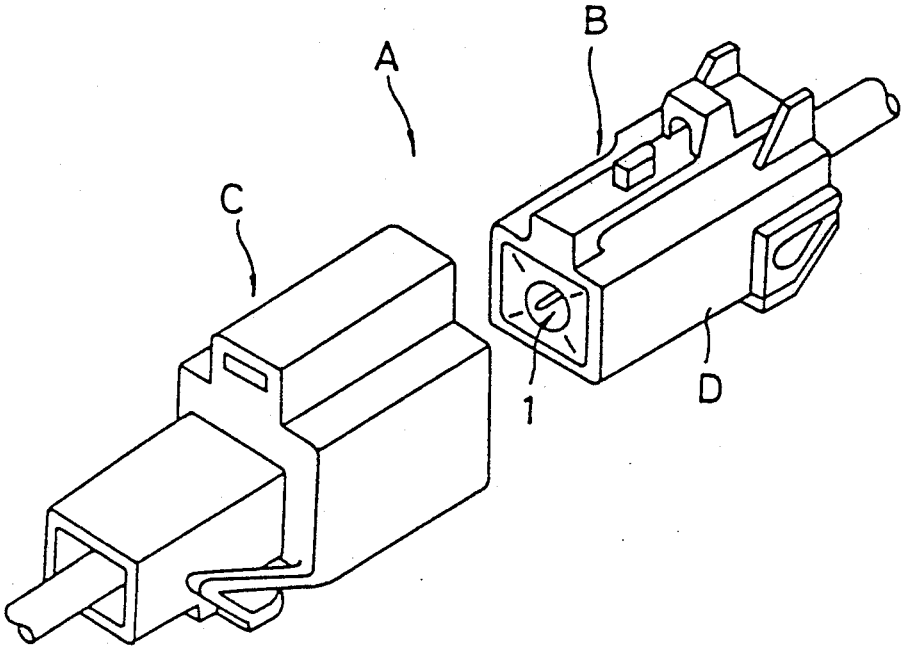
FIG. 1 is a perspective view of an electrical connector according to an embodiment of the invention before connection.
Figure 8:
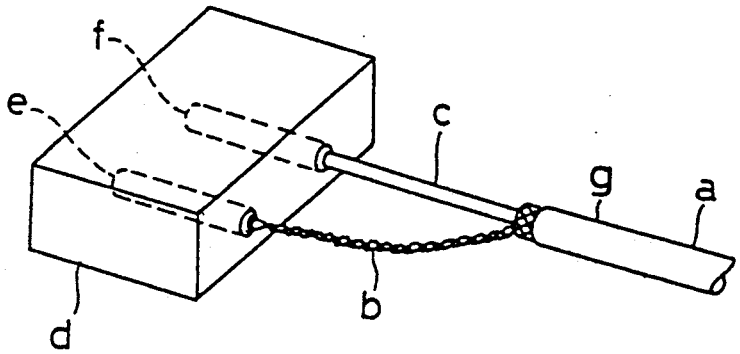
FIG. 8 PRIOR ART
FIG. 8 is a perspective view of a conventional electrical connector.

In FIG. 1, a connector A consists of a female connector B and a male connector C. The female connector B includes a housing D and a contact terminal 1 provided within the housing D.

Figure 9:
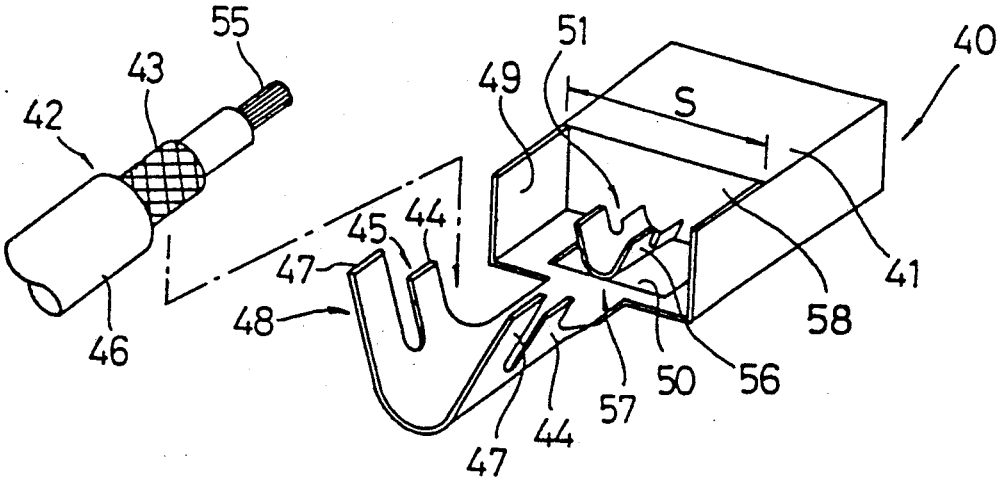
FIG. 9 is a perspective view of an electrical connector according to another embodiment of the invention.

In FIG. 9, an electrical contact terminal which is suitable for the automation of its wiring operation and has good shield effect. The contact terminal includes a shield jacket 40 having a contact support section 41; a shield braid crimping section 45 with a pair of crimping tabs 44 for crimping the shield braid 43 of a shielded cable 42; an outer sheath crimping section 48 with a pair of crimping tabs 47 for crimping the outer sheath 46 of the shielded cable 42; and a pair of tool openings 49 and 50; a signal line contact 51 with a signal line crimping section 57 having a pair of crimping tabs 56 for crimping the signal line 55 of the shielded cable 42; and an insulator block 58 fitted in the contact support section 41 for support the signal line contact 51.

Figure 10:
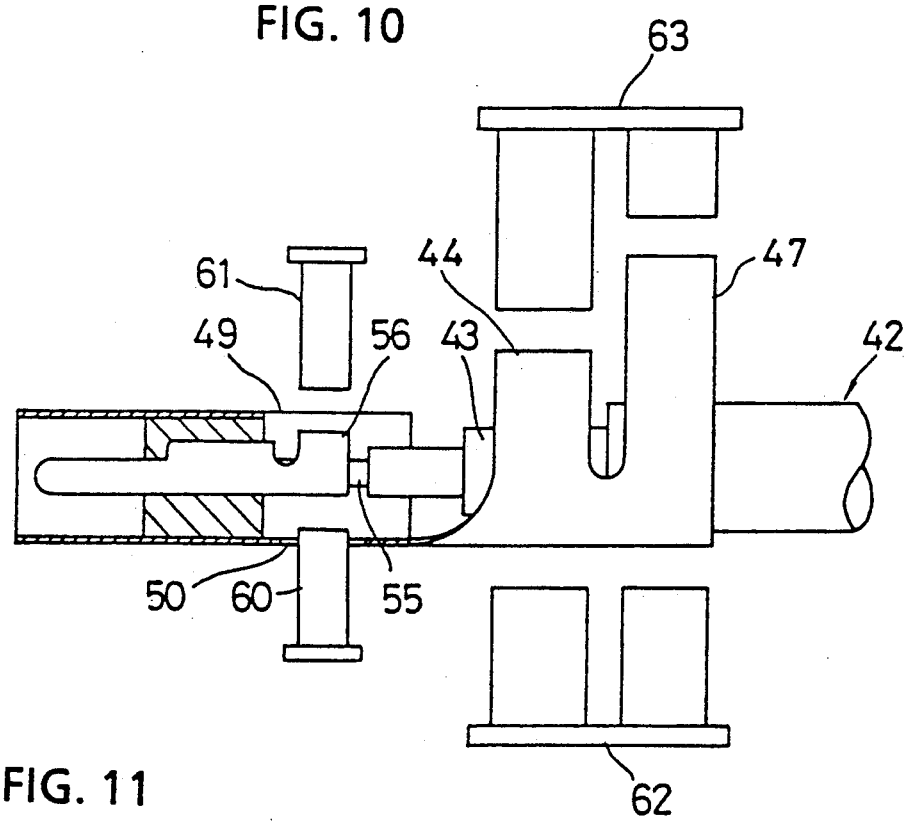
FIG. 10 is a side elevational view, partially in section, of the contact terminal useful for explaining how to connect a shielded cable to the contact terminal.

In FIG. 10, the front portion of the shielded cable 42, from which a length of shield braid 43 has been removed, is placed on the shield jacket 40 such that the signal line 55, the shield braid 43, and the outer sheath 46 rest between the respective crimping tabs 56, 44, and 47 of the signal line crimping section 57, the shield crimping section 45, and the outer sheath crimping section 48. Then, the crimping anvil 60 and the crimper die 61 are inserted through the tool openings 49 and 50 to crimp the crimping tabs 56 onto the signal line 55 while the crimping anvil 62 and the crimper die 63 are used to crimp the crimping tabs 44 and 47 onto the shield braid 43 and the outer sheath 46 respectively.

Figure 11:
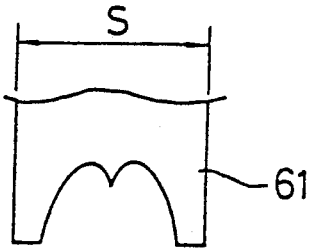
FIG. 11 is a front elevational view of a crimper die.

However, the crimping anvil 60 and the crimper die 61 are so large that it is impossible to reduce the tool opening 49 for the crimper die 61. That is, it is impossible that the width S of the shield jacket 40 is made smaller than that of the crimper die 61 (FIG. 11), thus putting a limit to the miniaturization of the electrical connector.

Figure 2:
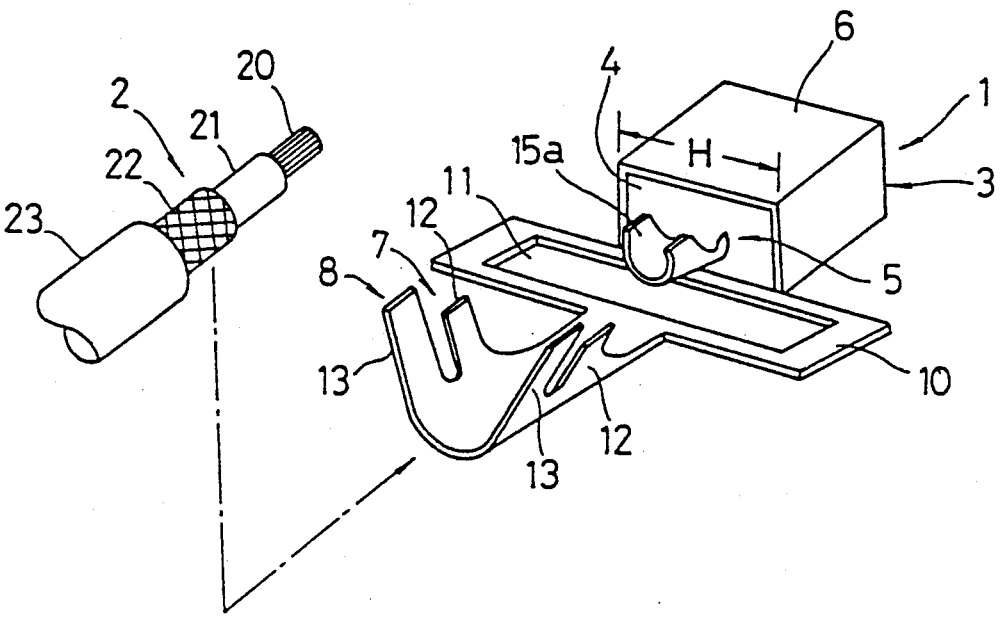
FIG. 2 is a perspective view of a contact terminal for the electrical connector.

In FIG. 2, the contact terminal 1 includes a shield jacket 3, an insulator block 4, and a signal line contact 5. The shield jacket 3 includes three sections; a rectangular contact support section 6, a U-shaped shield braid crimping section 7, and a U-shaped outer sheath crimping section 8. Between the contact support section 6 and the shield braid crimping section 7 there is provided a rectangular flat section 10 having a tool opening 11. The U-shaped shield braid crimping section 7 has a pair of crimping tabs 12. Similarly, the U-shaped outer sheath crimping section 8 has a pair of crimping tabs 13, which are made larger than the shield braid crimping tabs 12.

Figure 3:
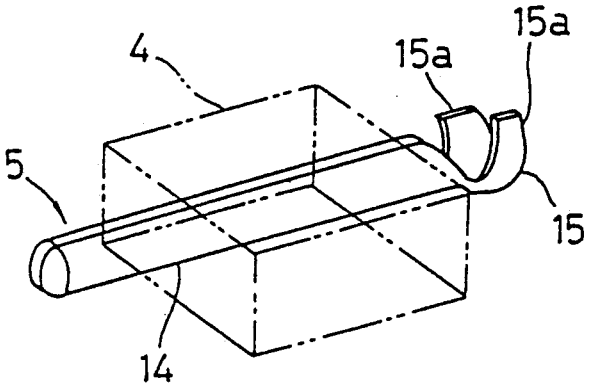
FIG. 3 is a perspective view of a signal line contact for the electrical connector.
Figure 4:
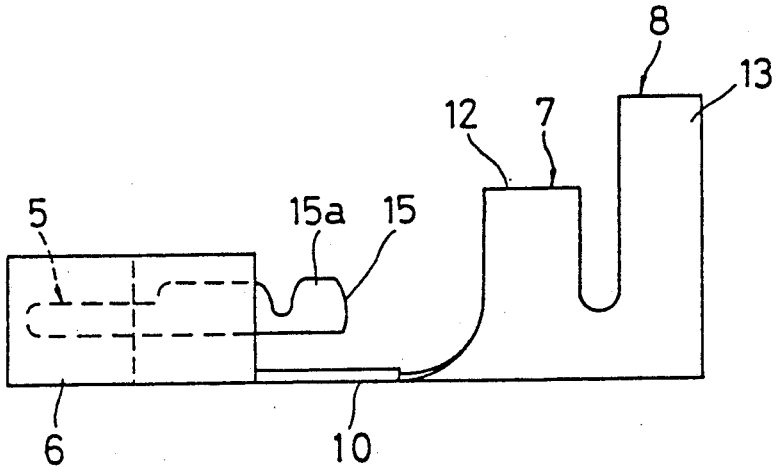
FIG. 4 is a side elevational view of the contact terminal.
Figure 5:
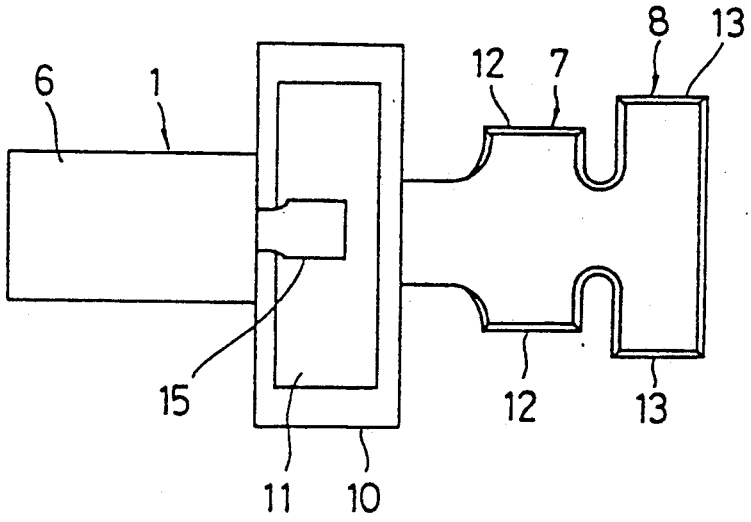
FIG. 5 is a top plan view of the contact terminal.

In FIG. 3, the signal line contact 5 includes a contact proper 14 and a signal line terminal 15. The contact proper 14 is made in the form of a pin. The signal line terminal 15 has a pair of crimping tabs 15*a* forming a U-shaped cross section. The signal line contact 5 is mounted in the contact support section 6 via the insulator block 4 such that the signal line terminal 15 is disposed above the tool opening 11, thus forming a contact terminal 1 before crimping.

In order to connect the shielded cable 2 to the contact terminal 1, the front portion of the shielded cable 2 is prepared as shown in FIG. 2 to expose the signal line (inner conductor) 20, an inner insulator 21, and a shield braid (outer conductor) 22 from the outer sheath 23.

Figure 6:
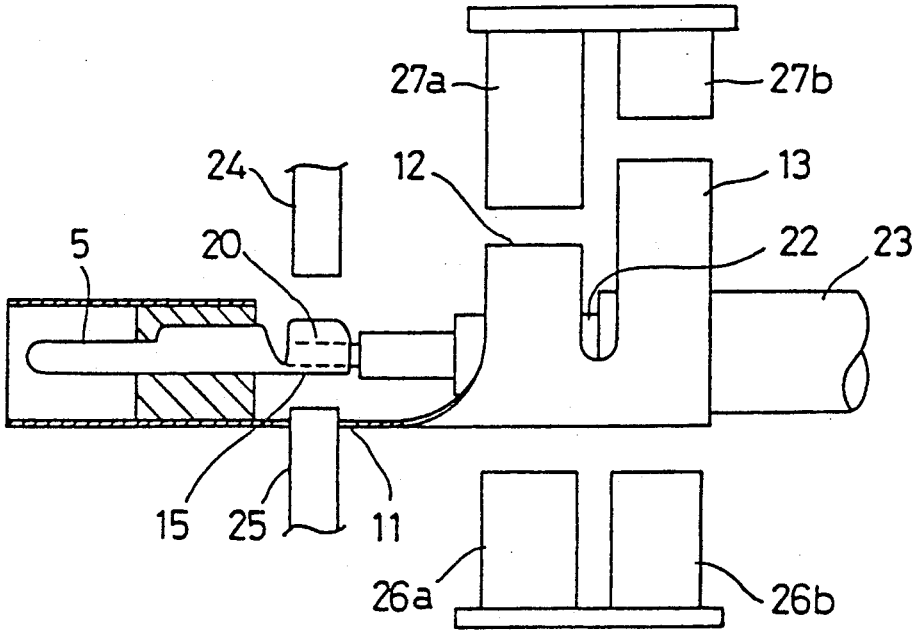
FIG. 6 is a side elevational view, partially in section, of the contact terminal useful for explaining how to connect a shielded cable to the contact terminal.
Figure 7:
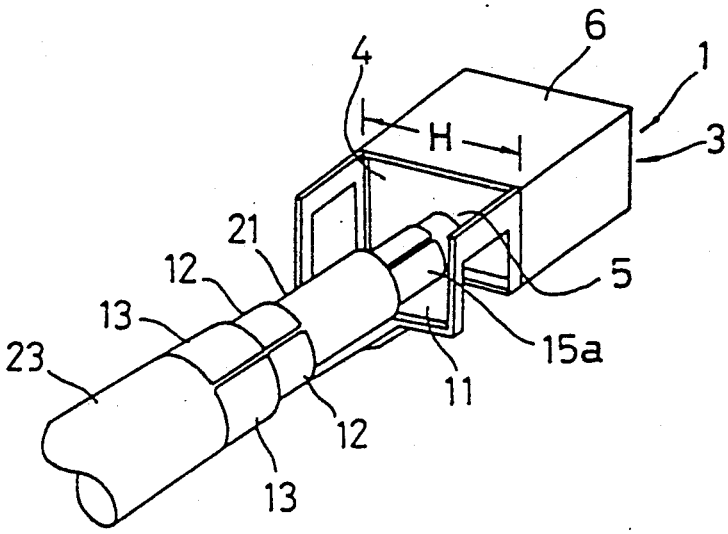
FIG. 7 is a perspective view of the contact terminal to which the shielded cable has been connected.

The front portion of the shielded cable 2 is placed on the contact terminal 1 so that the signal line 20, the shield braid 22, and the outer sheath 23 are placed between the respective crimping tabs 15*a*, 12, and 13. As FIG. 6 shows, it is possible to use the crimping anvil 25 and the crimper die 24 through the tool opening 11 in the flat section 10 as well as the crimping anvils 26*a* and 26*b* and the crimper dies 27*a* and 27*b* to crimp the respective crimping tabs 15*a*, 12, and 13 to the signal line 20, the shield braid 22, and the outer sheath 23, thereby connecting the shielded cable to the contact terminal 1. Then, opposite sides of the flat section 10 are bent upwardly so that it is possible to make the width H of the shield jacket 3 less than the width S of the crimper die 24.

As has been described above, according to the invention, it is possible to make not only the tool opening as small as the crimping anvil but also the width of the shield jacket smaller than that of the crimping die, thereby making the miniaturization of the connector possible.

We claim:

1. A miniature electrical contact terminal comprising:

a shield jacket including a contact support section, a flat section with a tool opening, a shield braid crimping section, and an outer sheath crimping section;

an insulator block fitted in said contact support section; and a signal line contact fitted in said insulator block such that a pair of signal line crimping tabs are placed above said tool opening.

2. The miniature electrical contact terminal of claim 1, wherein opposite sides of said flat section are bent upwardly so that said sides flash with opposite sides of said contact support section which has a width smaller than that of a crimper die.

3. The miniature electrical contact terminal of claim 1, wherein said tool opening in said flat section is as small as a crimping anvil.

* * * * *